US005199666A

United States Patent [19]

Williams

[11] Patent Number: 5,199,666

[45] Date of Patent: Apr. 6, 1993

[54] ROTARY SHREDDING APPARATUS WITH OSCILLATING GRATE

[76] Inventor: Robert M. Williams, 16 La Hacienda, St. Louis, Mo. 63124

[21] Appl. No.: 816,713

[22] Filed: Jan. 3, 1992

[51] Int. Cl.[5] ..... B02C 13/02; B07B 1/32

[52] U.S. Cl. ..... 241/73; 241/87; 241/236; 241/89.1

[58] Field of Search ..... 241/73, 84.4, 87, 89.1, 241/236, 88.4

[56] References Cited

U.S. PATENT DOCUMENTS

| | | | |
|---|---|---|---|
| 3,596,842 | 8/1971 | Barber | 241/236 X |
| 3,664,592 | 5/1972 | Schweigert et al. | 241/236 X |
| 3,682,396 | 8/1972 | Whitney et al. | 241/236 X |

FOREIGN PATENT DOCUMENTS

| | | | |
|---|---|---|---|
| 0558654 | 6/1958 | Canada | 241/73 |
| 0992086 | 1/1983 | U.S.S.R. | 241/73 |

*Primary Examiner*—Frank T. Yost
*Assistant Examiner*—Raymond D. Woods
*Attorney, Agent, or Firm*—Polster, Lieder, Woodruff & Lucchesi

[57] ABSTRACT

Shredding apparatus for reducing material by use of cutter discs mounted on each of a pair of spaced shafts which place the cutter discs in an interleaved operating position over a perforated grate which has active surfaces swept by the cutter discs, and a controllable drive for oscillating the grate so the normally inactive surfaces of the grate are also swept by the cutter discs.

9 Claims, 2 Drawing Sheets

FIG. 1.
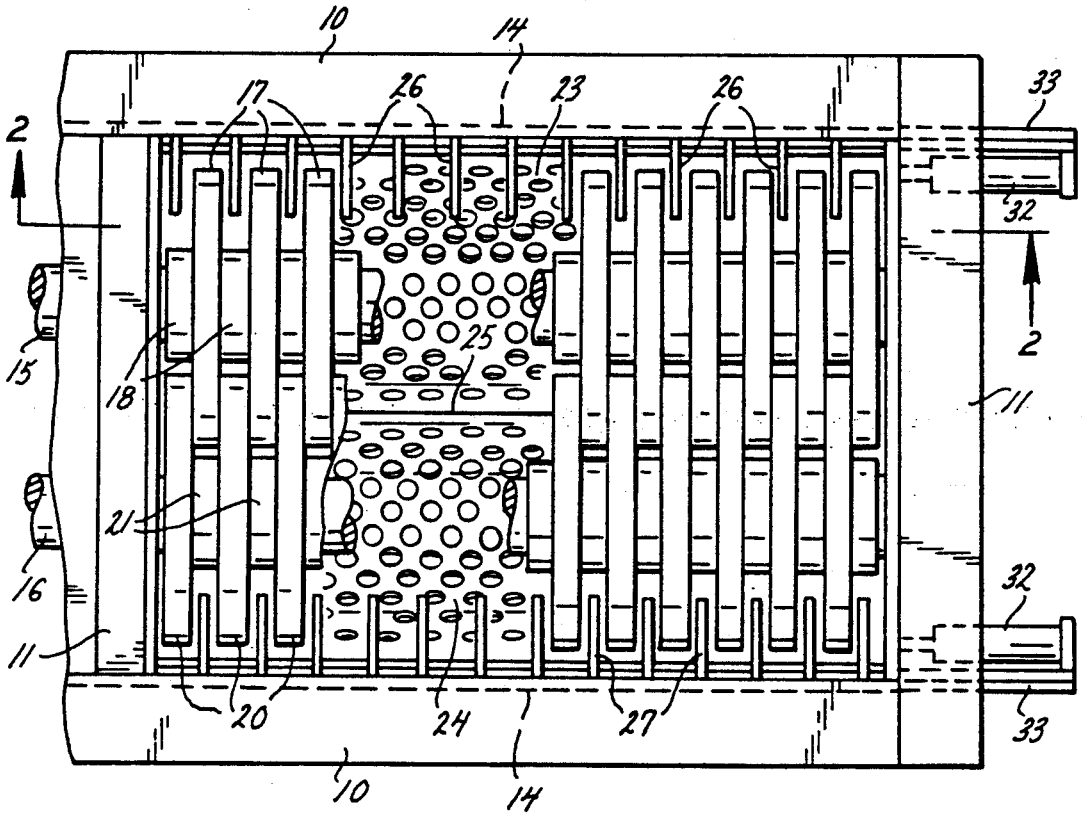
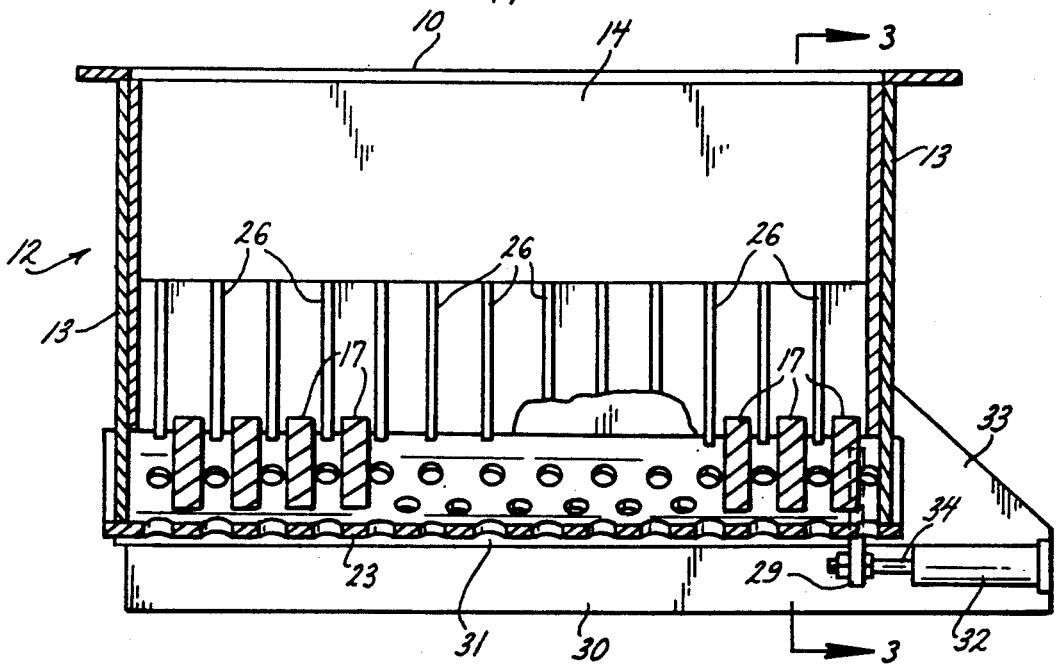
FIG. 2.

ROTARY SHREDDING APPARATUS WITH OSCILLATING GRATE

BACKGROUND OF THE INVENTION

1. Field of the Invention

This invention is directed to apparatus which operates cooperating rotors to break, rip and shear material to a size capable of passing through a perforated grate screen that is caused to move or oscillate so that substantially all areas of the grate screen are presented to the cooperating rotors.

2. Description of the Prior Art

Shredding apparatus for various items of waste material have been available in which parallel shafts have been provided with interleaved cutting or shearing elements. The shafts have been driven in opposite directions such that the interleaved elements operate to reduce the waste material in a shearing action, much like the action of scissors. It has been proposed also to provide the shredding apparatus with screen means at the outlet side of the shafts and interleaved elements to gauge the size of the reduced material. Furthermore, it has been proposed in prior apparatus to rotate the shafts at slow speeds and either in synchronism or at different speeds.

Shredding apparatus of the type in which parallel counter-rotating shafts, with shredding elements are employed, is exemplified by U.S. Pat. Nos. Panning et al 3,502,276 of Mar. 24, 1970; Brewer 3,578,252 of May 11, 1971; Rossler 3,662,964 of May 16, 1972; Schweigert et al 3,664,592 of May 23, 1952; Goldhammer 3,860,180 of Jan. 14, 1975; Cunningham et al 3,868,062 of Feb. 25, 1975; Baikoff 3,991,944 of Nov. 16, 1976; and Culbertson et al 4,034,918 of Jul. 12, 1977. The patents of Rossler and of Schweigert et al disclose fixed grates at the discharge side of comminuting apparatus.

Shredding apparatus disclosed in the prior art has a common problem with the accumulation of material that is partially reduced because of inactive or dead space left on the surface of the grate beneath the cutter discs on the rotor shafts, such dead spaces are located beneath the rotors that are interleaved on the respective shafts. The accumulation of material in the dead spaces is difficult to reduce except when other material entering the apparatus happens to crowd the material into the orbit of the rotors. Even reversible shredding apparatus has substantially the same difficulty.

SUMMARY OF THE INVENTION

The present invention is directed to improving the capability of shredders of the general class exhibited by the prior art examples to reduce waste material in such a way as to produce fine or coarse products, as well as to reduce material by breaking it into short lengths.

An important object of the invention is to provide the shredding apparatus with a grate structure that is mounted for oscillating movement in directions generally parallel with the shafts on which the rotor discs are carried.

Furthermore, it is an object to cause the grate to oscillate alternately in both directions so that the effect on the material being processed is to constantly subject all of the material to the shredding action of the rotor disc.

Another object of the invention is to construct the shafts on which the rotor shredding discs are carried and the grate which sizes the shredded material to have a relative oscillating motion to effectively present material accumulating in dead spaces so as to avoid the problems in the prior construction of shredder apparatus of the character disclosed in U.S. Pat. Nos. 3,664,592 of May 23, 1972 and 4,385,732 of May 31, 1983.

Other objects and advantages of the invention will be referred to the following description of a preferred embodiment.

BRIEF DESCRIPTION OF THE DRAWINGS

Reference hereinafter will be made to the drawing disclosure which comprises:

FIG. 1 which is a plan view of the shredder apparatus looking down into the frame;

FIG. 2 is a vertical view looking toward a side view of the frame along line 2—2 in FIG. 1;

DETAIL DESCRIPTION OF THE EMBODIMENT

Figure 3:
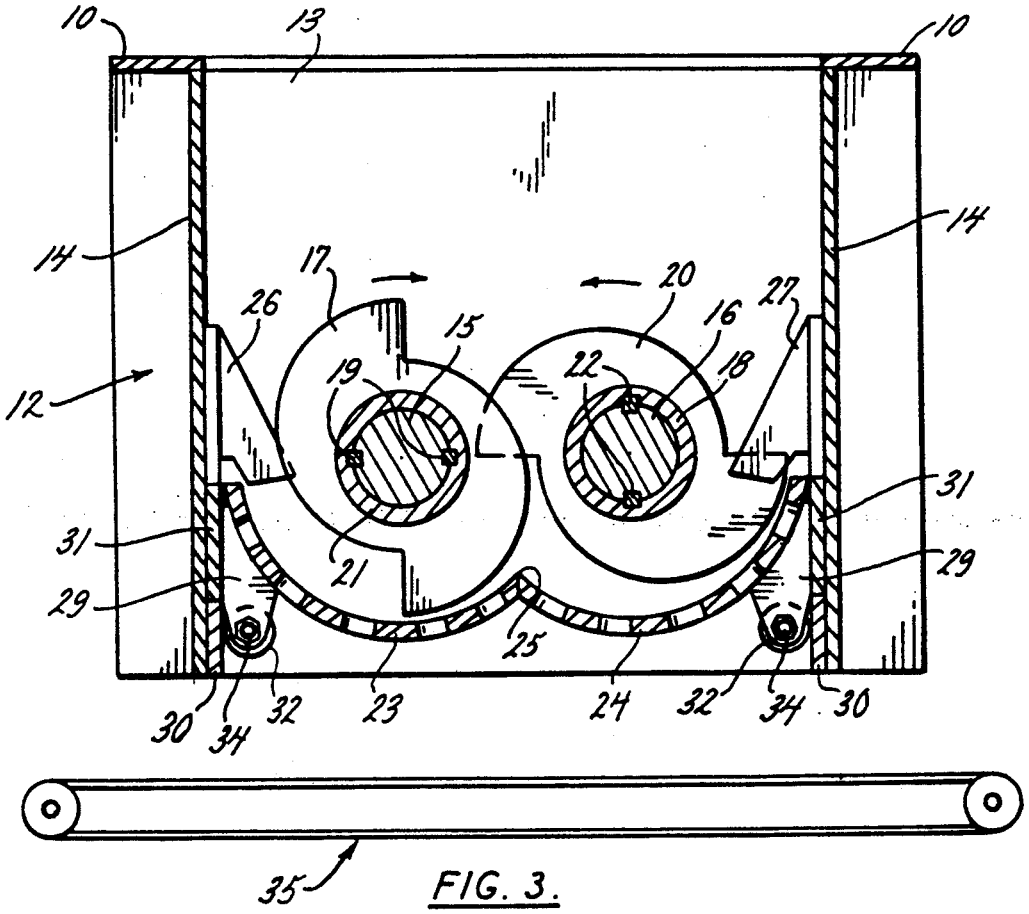
FIG. 3 is a vertical view at a pair of rotors and the cooperating grate as seen along line 3—3 in FIG. 2.

The plan view of FIG. 1 illustrates the longitudinal ledges 10 and the transverse ledges 11 which define the top opening of the general frame 12 seen in FIG. 2. A material receiving hopper (not shown) is adapted to be seated on the ledges 10 and 11 to guide material into the shredding apparatus operatively mounted in the frame 12. The shorter ledges 11 are located at the opposite ends of the frame to be at the top of the end walls 13. The longer flanges 10 are at the top of the side walls 14, and are parallel to the shafts 15 and 16. The shaft 15 is adapted to carry a series of cutter and shredding discs 17 retained in spaced relation by spacers 18 which slide on keys 19 (see FIG. 3) which engage the discs and spacers for rotation with the shaft 15. Similarly the shaft 16 carries a series of cutter and shredding discs 20 retained in spaced relation by spacers 21. The discs 20 and spacers 21 are connected to the shaft 16 by keys 22 (see FIG. 3). Furthermore, the discs 17 on shaft 15 are interleaved with discs 20 on shaft 16 so that the discs have a close fitting relation where they pass each other.

As shown in FIG. 1, the shafts and discs are broken away to reveal the presence of the grates 23 and 24 that meet with each other at the apex 25 (see also FIG. 3). The grates 23 and 24 may be separately formed and then joined at the apex 25, or the two parts 23 and 24 may be integrally formed.

FIG. 2 is a longitudinal section in elevation of the frame showing a side wall 14 which carries a series of combs 26 which project in a direction to assume fixed positions between the discs 17 on shaft 15. The combs 26 are adapted to present material for action by the discs 17 to break up such material. The opposite longitudinal wall 14 is similarly provided with combs 27 which cooperate with the discs 20 in breaking elongated material.

In most ripshear apparatus, the cutting discs on the shafts are axially spaced so the discs on one shaft interleave with the discs on the other shaft. Where a grate is incorporated at the discharge outlet, the surface of the grate is presented to the axially spaced discs so the discs can reduce the material when the discs sweep across the grate. However, the normal axial spacing of the discs results in the surface of the grate being rendered active directly beneath the discs, and the grate surface exposed between the discs is left to be inactive or dead. Since there are these normally inactive grate surfaces, the apparatus must depend on a longer operating time to achieve a uniform reduction of the material. In addition stationary combs are fixed in the apparatus, or are mounted on the grate as shown in U.S. Pat. No. 4,385,732. The problem has continued to be in the formation of inactive or dead grate surfaces between the discs. Such dead spaces are located beneath the combs 26 in FIGS. 1 and 2 and between the discs 17.

A unique feature of the apparatus is the arrangement of brackets 29 on the margins of the grates 23 and 24 supported on slide tracks 30 fixed to the side walls 14. The brackets include slides 31 which support the grates 23 and 24 on the tracks 30. A fluid pressure cylinder 32 is mounted in a suitable frame support 33 (see FIG. 2) so its piston rod 34 can be connected to the adjacent bracket 29 (see FIG. 2). The rods 34 do not have to have more than a stroke substantially equal to the distance between the spaced discs 17 or 20 so that the grates 23 and 24 are able to present the surfaces of the grates to be swept by the adjacent discs 17 and 20. By oscillating the grates in opposite directions on tracks 30, the discs 17 and 20 are able to sweep the longitudinal surfaces of grates 23 and 24 and effectively reduce all material which is then deposited on a suitable conveyor 35 to be removed from the apparatus discharge.

Figure 4:
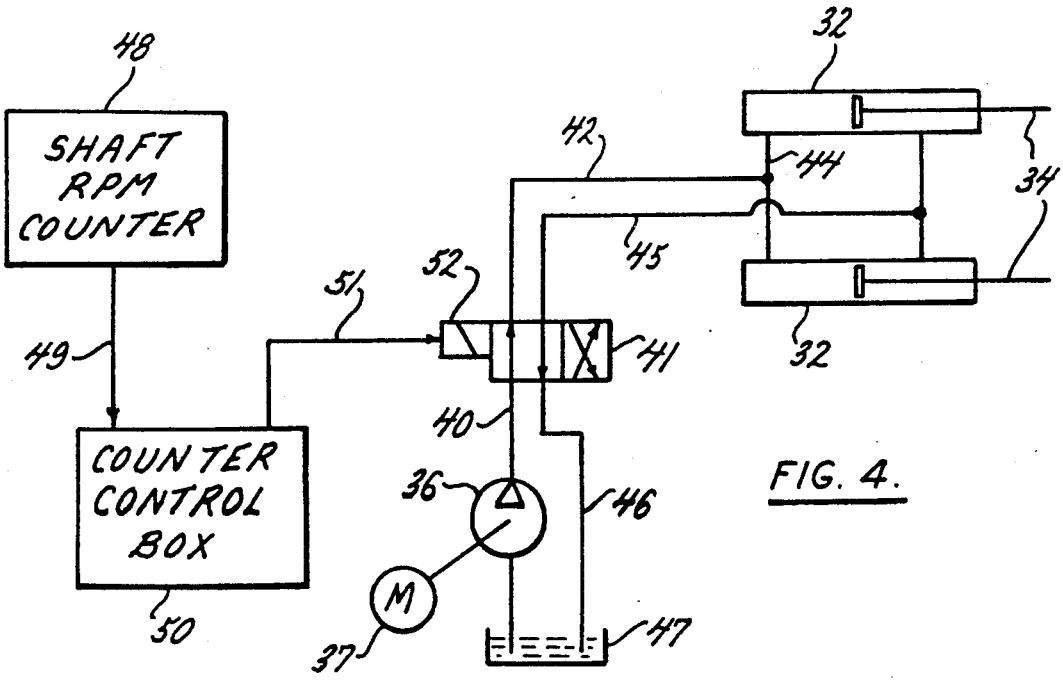
FIG. 4 is a schematic diagram of a control system for effecting the oscillating motion of the perforated grate relative to the cutter discs.

FIG. 4 is a schematic disclosure of the control system associated with the oscillating grates 23 and 24 so they move as a single part. The drive means for the shafts 15 and 16 has not been disclosed as it can be taught in the prior U.S. Pat. 4,385,732. In that patent a common drive motor is connected through a gear-type transmission for operating the shafts to rotate in the opposite direction, either at the same RPM, or at different RPM's. The control system is composed of a pump 36 driven by an electric motor 37 to draw fluid from a reservoir 47. The pump delivery line 40 is connected to flow directing valve 41 positioned by a spring (not shown) to seek a position to direct fluid into conduit 42 and then into conduit 44 connected to supply the pressure fluid to the fluid pressure cylinders 32 for extending the piston rods 34 at the same time. The fluid in cylinders 32 returns by conduit 45 to the valve 41 for return by conduit 46 to reservoir 47.

In the control circuit a counter device 48 responsive to the rotation of one of the shafts 15 or 16 generates a continuous RPM count. The count signals thus generated are transmitted by line 49 into a selective programmable counter control 50 that is connected by line 51 to a solenoid 52 so that a selected number of shaft rotations programmed into a predetermined sequence of counts can shift the valve 41 against the spring so the cylinders 32 are reversed by being retracted for the predetermined shaft rotation count to result in shifting the grates 23 and 24. Thus the valve 41 is alternately actuated to shift the grates 23 and 24 so that the dead spaces are passed under the cutter discs 17 and 20 as the grate slides 31 move on tracks 30 (See FIG. 3).

The fluid pressure circuit seen in FIG. 4 is what is called an open loop circuit in which the control over the valve 41 is by a spring to move the valve spool to a position in which pressure fluid flows to line 42 and return fluid flows in lines 45 and 46 back to the reservoir 47. When, on the other hand, the counter control in box 50 has counted the predetermined number of rotations of one of the shafts 15 or 16, a signal is sent to solenoid 52 to allow the spring to shift the valve spool so pressure fluid from line 40 now flows to line 45 and the return flow is in line 42 to line 46 and back to the reservoir 47. If a jam occurs to the rotor discs 17 and 20 there is provided in the counter control box a sensor which responds to the cessation of counting by the shaft RPM counter 48 to signal the shaft drive means to reverse the shafts so the jam can be cleared if the forward drive of the shafts 15 and 16 is not resumed within a preset time. However, the principal object is to provide for oscillating the grates 23 and 24 to continually clear material from accumulating in spaces that heretofore have been dead spaces in the surfaces of the grates. The theory of the reversing circuit taught in 4,452,400 is incorporated herein by reference with the differences described in relation to FIG. 4. In apparatus having non-reversing driven shafts, as is disclosed herein, the rotation counting feature may employ any one of several speed switch devices of Electro Sensors disclosed in Speed Monitoring Systems, Form AD 300, Rev. A.

What is claimed is:

1. In material reducing apparatus having a frame with a material inlet and a classified material outlet of a desired size, a pair of parallel rotatable shafts mounted in said frame, a plurality of material reducing cutter discs fixed on each shaft with the discs on each shaft overlapping those on the other shaft, a material classifier grate mounted in the material outlet and formed with perforations for sizing material reduced by the cutter discs, said overlapping cutter discs being axially spaced along said shafts thereby leaving deed spaces on said grate surface of the dead spaces on said grate to be swept by said cutter discs.

2. The improvement set forth in claim 1 wherein said grate is caused to oscillate in accordance with a predetermined sequence of rotation of said shafts.

3. The improvement set forth in claim 1 wherein said grate is formed with a pair of surfaces positioned to locate one of said pair of surfaces adjacent each of said cutter discs on each of said rotatable shafts, said surfaces being configured to substantially match the circularity of said cutter discs on said rotary shafts.

4. The improvement set forth in claim 1 wherein said frame carries slide tracks, and said grate is movably supported on slides engaged on said slide tracks.

5. The improvement set forth in claim 1 wherein said means operatively oscillating said grate comprises reversible fluid pressure means connected to said grate, shaft rotation pick-up means, and selective programmable control means interconnecting said fluid pressure means and said rotation pick-up means for periodically reversing said fluid pressure means in accordance with a program of shaft rotations selected by said control means.

6. The improvement set forth in claim 1 wherein said grate is formed with a pair of circular sections joined at an apex located between said cutter discs on each of said pair of shafts, said circular sections of each of said grates presents a surface substantially matching said cutter discs with dead areas on said grate surfaces between said axially spaced cutter discs which are rendered active upon grate oscillation.

7. In apparatus for reducing material to a predetermined size having a frame defining an inlet for the material to be reduced and an outlet, a pair of rotatable shafts in spaced parallel positions mounted in said frame, a plurality of material cutting discs mounted in axially spaced relation on each shaft and said shafts being in spaced relation, with the axially spaced cutter discs on one shaft interleaved with the axially spaced cutter discs on the other shaft, the rotation of said shafts being such that the interleaved cutter discs direct the inlet material to pass downwardly between said spaced shafts, perforated grate means in said frame underneath said cutting discs in position to present normally active and inactive perforated surfaces to the rotary travel of said cutting discs, the improvement characterized in that means is connected to said grate means for oscillating said grate means whereby the perforated surfaces thereof are moved relative to said interleaved cutting discs upon a predetermined number of shaft rotations whereby said normally inactive surfaces of said perforated grate means are rendered active by said cutting discs.

8. The improvement set forth in claim 6 wherein said frame is formed with tracks directed parallel to said pair of shafts, and slide elements on said grate engaged on said tracks.

9. The improvement set forth in claim 8 wherein the means operatively oscillating said grate comprises power means connected to move said grate slide elements on said tracks, and control means is operatively connected to said power means for periodically reversing the power means to impart an oscillating motion to said grate.

* * * * *

UNITED STATES PATENT AND TRADEMARK OFFICE

CERTIFICATE OF CORRECTION

PATENT NO. : 5,199,666

DATED : April 6, 1993

INVENTOR(S) : Robert M. Williams

It is certified that error appears in the above-identified patent and that said Letters Patent is hereby corrected as shown below:

Col. 4, line 30 "deed" should be "dead"

Col. 4, line 30, after "grate" and before "surface" insert "between said axially spaced cutter discs on each shaft not swept by said axially spaced cutter discs, the improvement characterized in the provision of means operatively oscillating said grate in directions parallel to the axes of said rotatable shafts and relative to said axially spaced cutter discs for presenting the"

Signed and Sealed this

Seventh Day of December, 1993

Bruce Lehman

*Attest:*

BRUCE LEHMAN

*Attesting Officer*

*Commissioner of Patents and Trademarks*